United States Patent [19]

Natori et al.

[11] 4,060,974

[45] Dec. 6, 1977

[54] METHOD AND APPARATUS FOR DRIVING ELECTROCHROMIC DISPLAY DEVICE

[75] Inventors: Minoru Natori, Tokyo; Toshikazu Hatuse, Tanashi; Kouhei Kawanobe, Kawagoe; Hiroshi Ogawa, Tokorozawa; Fukuo Sekiya, Tokorozawa; Heihachiro Ebihara, Tokorozawa; Misao Uchino, Tokorozawa, all of Japan

[73] Assignee: Citizen Watch Company Limited, Tokyo, Japan

[21] Appl. No.: 701,971

[22] Filed: July 1, 1976

[30] Foreign Application Priority Data

| | | |
|---|---|---|
| July 2, 1975 | Japan | 50-81581 |
| July 31, 1975 | Japan | 50-92550 |
| Aug. 12, 1975 | Japan | 50-97934 |

[51] Int. Cl.[2] ..... G04C 3/00

[52] U.S. Cl. ..... 58/23 R; 58/50 R

[58] Field of Search ..... 58/4 A, 23 R, 23 A, 58/50 R; 340/324 M, 336; 350/160 R, 160 LC

[56] References Cited

U.S. PATENT DOCUMENTS

| | | | |
|---|---|---|---|
| 3,807,832 | 4/1974 | Castellion | 350/160 LC |
| 3,828,548 | 8/1974 | Martin | 58/50 R |
| 3,839,857 | 10/1974 | Berets et al. | 58/23 R |
| 3,950,936 | 4/1976 | Oguey et al. | 58/23 R |
| 3,979,899 | 9/1976 | Toshida et al. | 58/4 A |
| 3,987,433 | 10/1976 | Kennedy | 340/336 |

*Primary Examiner*—Robert K. Schaefer
*Assistant Examiner*—Vit W. Miska
*Attorney, Agent, or Firm*—Holman & Stern

[57] ABSTRACT

A method and apparatus for driving an electrochromic display device in which an electric current is applied only to one of display elements for which non-coincidence exists between an initially applied display information signal and a subsequently applied display information signal. In one preferred embodiment, a driver circuit comprises a latch circuit for storing a display information signal, a non-coincidence detection circuit for detecting non-coincidence between a subsequently applied display information signal and an initially applied display information signal stored in the latch circuit, and a signal generating circuit responsive to a non-coincidence signal from the detection circuit for generating an output signal for a display element for which non-coincidence is detected. In another preferred embodiment, a driver circuit comprises a latch circuit for generating an output at the instant delayed from a display information signal, and gate means for generating an output signal in response to the display information signal and the output from the latch circuit.

2 Claims, 10 Drawing Figures

METHOD AND APPARATUS FOR DRIVING ELECTROCHROMIC DISPLAY DEVICE

This invention relates to a method and apparatus for driving an electrochromic display device and, more particularly, to a driver circuit specifically suited for an use in electronic timepiece of the type using the electrochromic display device.

Although liquid crystal display devices have been widely exploited as electro-optical display means, electrochromic display devices have been recently used in various applications such as electronic timepieces and calculators, etc. In general, liquid crystal display devices employ the application of electric potentials to alter the orientation of liquid crystals, with information being displayed by changing such electro-optical characteristics as the dispersion of light or by the effect of rotating the polarization plane. Electrochromic display devices, on the other hand (hereinafter referred to as EC display devices), use electric potentials to bring about a current flow through an electrochromic substance such as $WO_3$ or $MoO_3$, whereby reduction and coloration of the electrochromic substance is achieved. This state of coloration has a persistence which lasts for periods of from one minute to one week in length, while the application of an opposite voltage or heat oxidizes the material and erases its color.

In structure, an EC display device may be of solid state type in which a transparent electrode, an EC layer, an insulating layer and a thin counter electrode film are disposed on a single transparent glass substrate; a liquid type in which a transparent electrode, an EC layer or an insulating layer on a lead wire are disposed on an upper single transparent glass substrate and a counter electrode of carbon or the like is disposed on a lower substrate, with an electrolyte such as $H_2SO_4$ sealed between both substrates; or an organic liquid type in which an organic substance is colored or bleached by suitably reversing an electric potential.

When changing a displayed digit from "1" to "2", for example, all of the segments are first temporarily erased and then an electric current is caused to flow through the proper segments for illuminating and displaying the digit "2". This holds for conventional method of driving EC display elements but the electrochromic materials have a persistence which makes it unnecessary to bleach a particular segment which will be commonly used to provide a display of a desired digit while the application of a potential bleaches the undesired segment and colors anew segments to provide the display of the desired digit. Since the power consumption of the EC display device is greater than that of the liquid crystal display device, it is highly desirable to drive the EC display device so as to minimize the power consumption.

It is, therefore, an object of the present invention to provide an improved method of driving an electrochromic display device which can overcome the shortcomings encountered in the prior art.

It is another object of the present invention to provide an improved driver circuit for an electrochromic display device which can minimize power consumption.

It is another object of the present invention to provide an improved driver circuit which can drive an electrochromic display device in a highly reliable manner.

It is another object of the present invention to provide an improved driver circuit for an electrochromic display device which is simple in construction and easy to manufacture.

It is still another object of the present invention to provide an improved driver circuit for an electrochromic display device which is specifically suited for use in an electronic timepiece.

It is still another object of the present invention to provide an improved driver circuit for an electrochromic display device which can be incorporated in an integrated circuit chip of an electronic timepiece.

It is a further object of the present invention to provide an electronic timepiece of the type employing an electrochromic display device.

These and other objects, features and advantages of the present invention will become more apparent from the following description when taken in conjunction with the accompanying drawings, in which.

Figure 1:
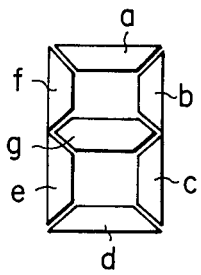
FIG. 1 is a schematic view of a display pattern of seven segments to carry out a driving method of the present invention.
Figure 2:
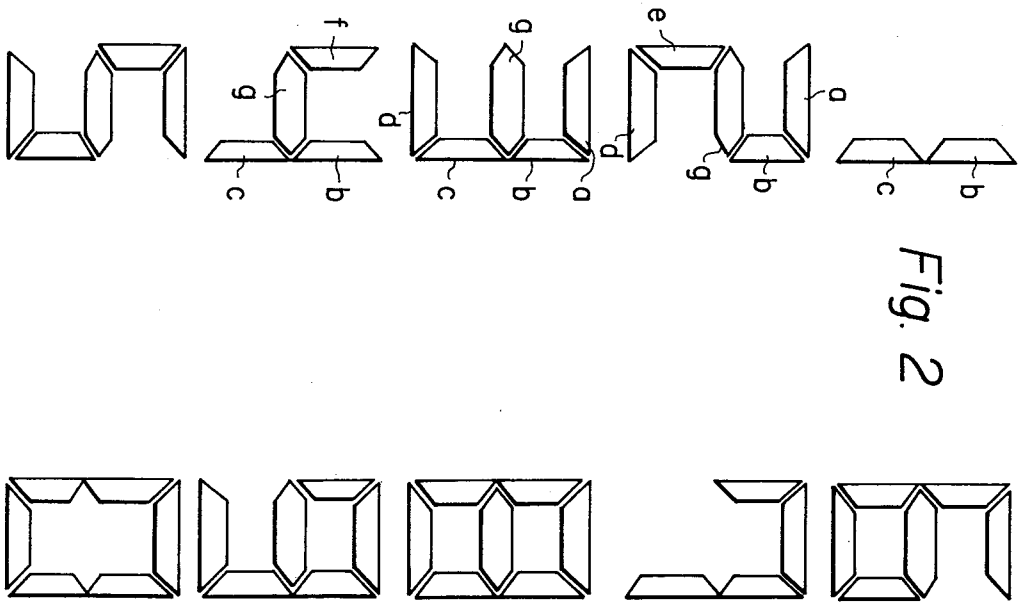
FIG. 2 shows modes of displaying digits using the segments of FIG. 1 in a case where the segments are applied to a display of an electronic timepiece.
Figure 3:
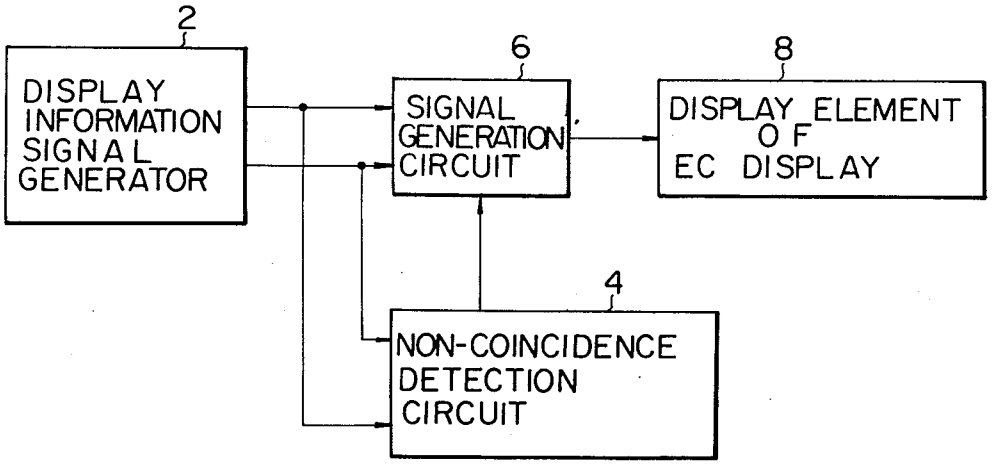
FIG. 3 is a block diagram illustrating the driving method according to the present invention.

Referring now to FIGS. 1 and 2, there are schematically shown a display pattern of seven segments and modes of displaying digits using the seven segments shown in FIG. 1. In an electronic timepiece, it has been a usual practice to display digits from a lower to a higher order, viz., "1", "2", "3", "4" . . . Thus, the digit "1" is displayed by the segments *b* and *c* in FIG. 2. When changing a displayed digit from "1" to "2", the segments *b* and *c* are first temporarily erased and then an electric current is caused to flow through the segments *a, b, d, e* and *g*. This method makes it necessary to drive the seven segments, increasing power consumption. This holds for conventional method of dricing EC display elements but the electrochromic materials have a persistence which makes it unnecessary to bleach the segment *b*. In accordance with the present invention, an electric current is not caused to flow through the segment *b* which remain in its previously colored state, and a reversed porality voltage is applied to the segment *c* while the application of a voltage colors anew segments *a, d, e* and *g*. To this end, display information signals from display information signal generator 2 are supplied to non-coincidence detection circuit 4, in which the display information signals for each display element are compared as shown in FIG. 3. When non-coincidence is detected, non-coincidence detection circuit 4 generates a non-coincidence signal, which is applied to signal generation circuit 6. Signal generation circuit 6 is arranged to generate a drive signal in response to an output signal from non-coincidence detection circuit 4. Thus, the drive signal is applied to display element 8 of an electrochromic display device to provide or remove coloration. For example, when changing the displayed digit from "1" to "2", a display information signal for the display segment *b* coincides with the display information signal which has previously been applied to the segment *b* when the digit "1" is displayed. Accordingly, non-coincidence detection circuit 4 does not generate an output signal and, accordingly, signal generation circuit 6 does not generate a drive signal for the display segment *b*. Thus, the display segment *b* remains in its previously colored state. On the other hand, a display information signal for the display segment *c* is not coincided with the display information signal which has previously been applied to the display segment *c* during the display of the digit "1". In this instance, a non-coincidence signal is applied to signal generation circuit 6, which generates a drive signal. This drive signal is applied to display element 8 and, consequently, an electric current will flow through the display segment *c* in a bleaching direction. Further, there exists non-coincidence between display information signals applied to each of the display segments *a, d, e* and *g* when the displayed digit changes from "1" to "2". In these conditions, drive signals are generated by signal generation circuit 6 to color segments *a, d, e* and *g*. It is thus possible to reduce power consumption by applying an electric current to only five segments. When changing a displayed digit from "2" to "3", only two segments *c* and *e* are driven. Namely, a voltage is applied to the segment *c* to provide coloration and a reversed porality voltage is applied to the segment *e* to remove coloration. Other segments *a, b, d* and *g* remain in their previously colored states without the application of a voltage. Accordingly, while in a conventional driving method it is necessary to drive ten segments, the present method makes it possible to drive only the segments *c* and *e* and, therefore, the power consumption can be reduced by an amount equal to that required for driving eight segments. A digit "4" is displayed by the segments *b, c, f* and *g*. This is achieved by applying a reversed porality voltage to the segments *a* and *d* while applying a voltage to the segment *f*. No current is applied to the segments *b, c* and *g* because these segments are persistent. In this matter, the electric current is applied only to the segments *a, d* and *f* and, therefore, the power consumption that would otherwise be caused by driving 6 segments can be reduced.

In the same manner as already stated hereinabove, when a displayed digit is changed from "4" to "5" the power consumption required to drive six segments is reduced. When changing a displayed digit from "5" to "6", from "6" to "7", from "7" to "8", from "8" to "9", from "9" to "0" and from "0" to "1", it is possible to reduce power consumptions by amounts equal to those required for driving 6, 10, 6, 8, 12, 10 and 4 segments, respectively. While in the prior art method it is necessary to drive one hundred segments to provide a display of one cycle of the digits, the driving method of the present invention makes it possible to drive only twenty eight segments, reducing the power consumption by an amount equal to that required for driving seventy two segments. In a case where an electrochromic material having a relatively short period of persistence effect is used, an electric current may be appropriately applied to particular segments (i.e., segments *c* and *e*) which are open circuit for a long period. In addition, the display device may be used to display digits, characters, pictures, symbols, etc.

Figure 4:
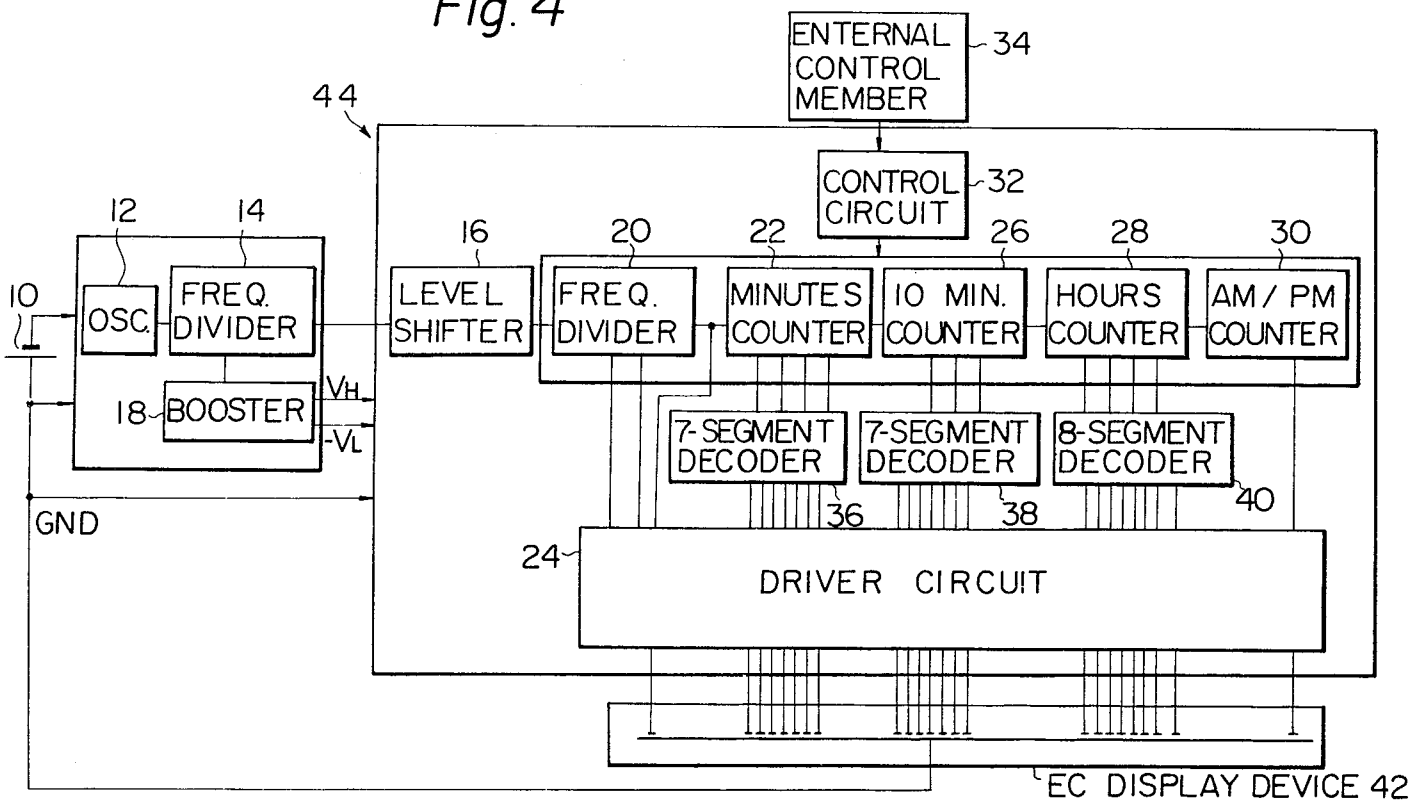
FIG. 4 is a block diagram of an electronic timepiece according to the present invention.

FIG. 4 illustrates a block diagram of a preferred embodiment of an electronic timepiece according to the present invention. The timepiece has a power source such as battery 10, which is coupled to crystal controlled oscillator 12. An output from oscillator 12 is fed to frequently divider 14, the output from the final stage of which is supplied to signal level converter circuit 16 (hereinafter referred to as a level shifter). The other output from divider 14 is fed to booster 18 which, under the influence of this signal, raises the potential on the high and low sides of battery 10. The boosted output voltage is then fed to the circuit block to be described below. Oscillator 12, divider 14 and booster 18 are all actuated by the voltage supplied by the battery 10. Accordingly, the output signal from divider 14 derives from the potential as supplied by the battery. Level shifter 16 converts the signal fed from divider 14 to a signal which derives from the output potential $V_H$ on the high potential side of booster 18 and the output potential $-V_L$ on the low potential side, and then sends this signal to frequency divider 20. The signal is divided down to a signal having a period of 1 minute which is supplied to minutes counter 22. In addition, a timing signal is fed to driver circuit 24. The output from minutes counter 22 is fed to 10 minute counter 26, the output of 10 minute counter 26 is fed to hours counter 28, and the output of hours counter 28 is fed to AM/PM counter 30, thereby constituting a time counter group.

Control circuit 32 is responsive to a signal from external control member 34 to control divider 20, minutes counter 22, 10 minute counter 26, hours counter 28, and AM/PM counter 30, thereby allowing time corrections. Time information signals from minutes counter 22, 10 minute counter 26 and hours counter 28 are fed respectively to 7-segment decoder 37 7-segment decoder 38 and 8-segment decoder 40, whereby each decoder converts the signals to display information signals for each display element i.e., for each segment. Display information signals from each decoder, timing signals from divider 20 and signals from AM/PM counter 30 are applied to driver 24 which produces output drive signals fed to each segment electrode of EC display device 42. The circuit groups denoted by block 44, with the exception of level shifter 16, all run on output voltages $V_H$ and $-V_L$ as supplied by booster 18.

Figure 5:
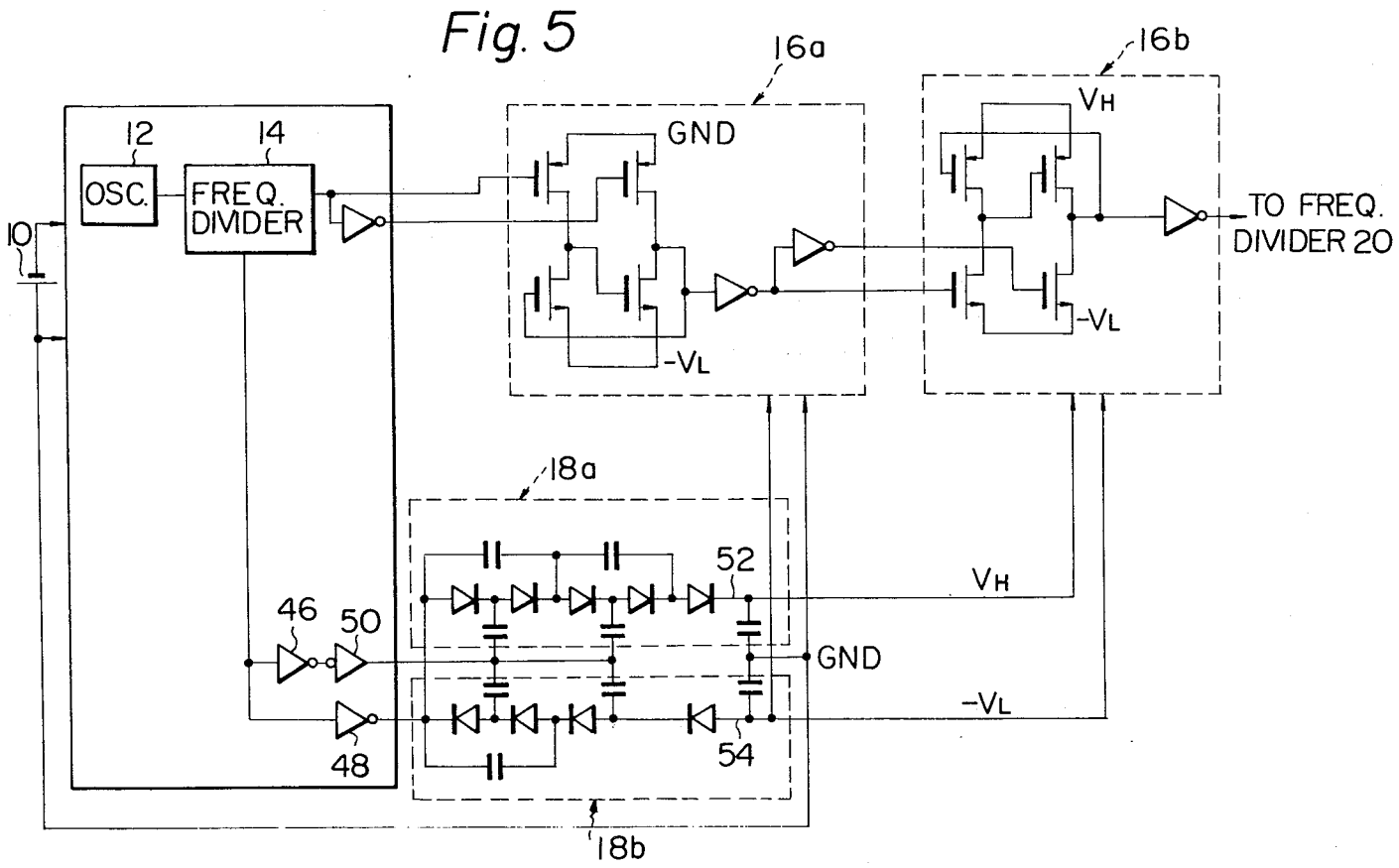
FIG. 5 is a circuit diagram showing an example of a signal level converter circuit and booster of FIG. 4.

FIG. 5 illustrates a preferred example of the booster 18 and level shifter 16 shown in FIG. 4.

In FIG. 5, the output of divider 14 is applied to the booster inverters 46 and 48 and the output of inverter 46 is applied to inverter 50. As a result, the outputs from inverters 48, 50 are signals mutually inverted in phase which are then applied to boosters 18*a* and 18*b*. Block 18*a* boosts the potential on the high side of the battery to a higher level, and applies this as a direct current output voltage $V_H$ along the line 52. Block 18*b* boosts the potential on the low side of the battery to a still more negative level and applies this as a direct current output voltage $-V_L$ along line 54.

Blocks 16*a*, 16*b* define a level shifter. Block 16*a* is a first level shifter for converting the output signal from divider 14, which derives from the potential as supplied by the battery, to a signal which derives from the potential taken from across the potential GND on the high potential side of the battery and the potential $-V_L$. Block 16*b* is a second level shifter for converting the signal derived from the potential taken from across GND and $-V_L$ to a signal which derives from the potential taken from across $V_H$, $-V_L$. The first and second level shifters act to shift the signal derived from the battery potential to a signal having a potential for actuating the circuit which constructs divider 20 to be described below.

Figure 6:
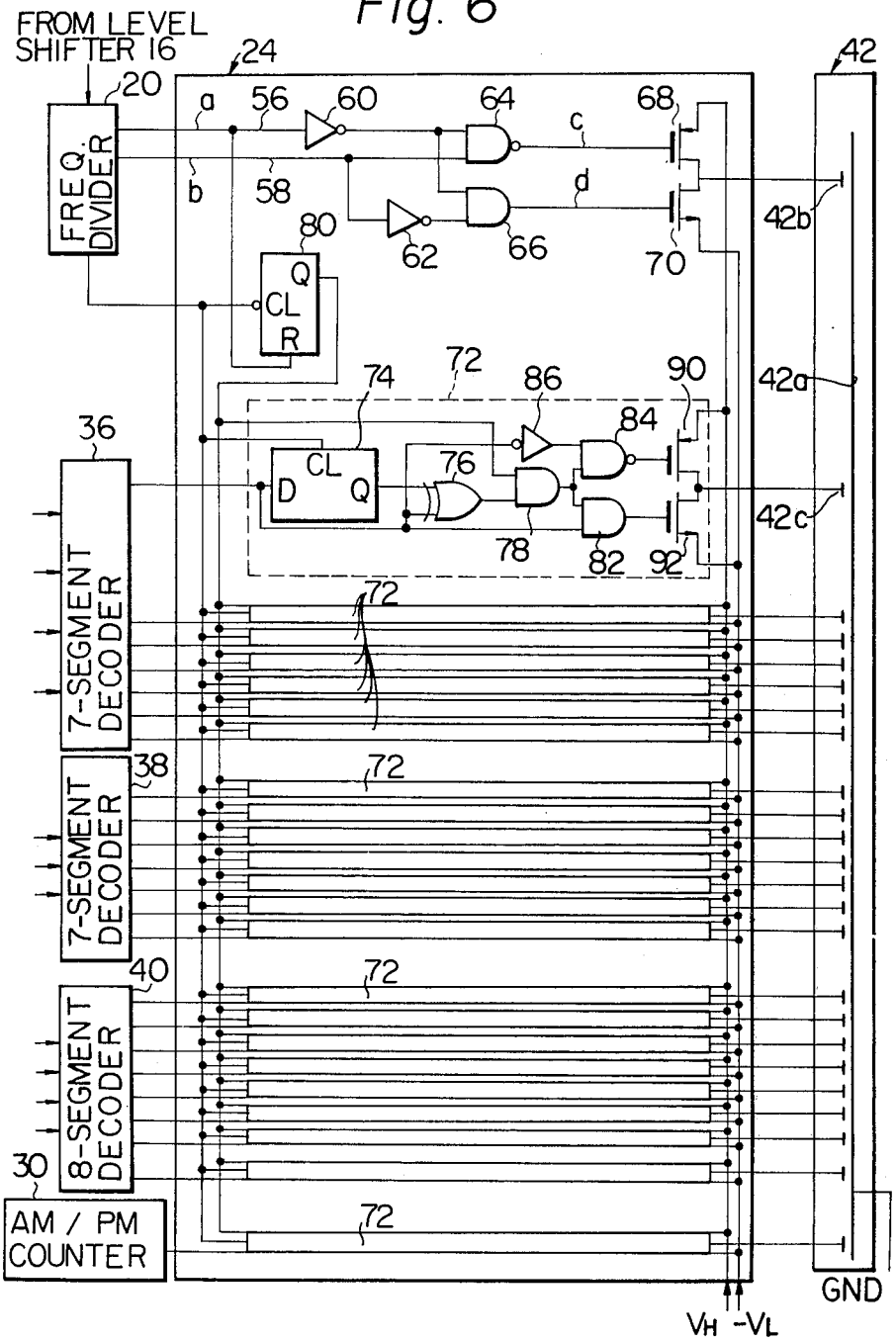
FIG. 6 is a circuit diagram of a preferred embodiment of a driver circuit of FIG. 4.
Figure 7:
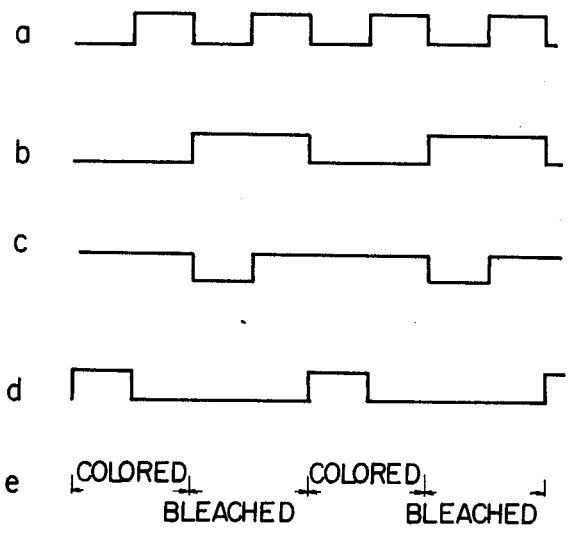
FIGS. 7 and 8 show timing charts illustrating the operation of the driver circuit shown in FIG. 6.

FIG. 6 shows a preferred embodiment of driver circuit 24 illustrated previously in FIG. 4. Corresponding blocks share similar block numbers. In FIG. 6, the EC display device 42 attains a colored state when each segment electrode is at a negative level while the common electrode is at the ground potential. A bleached state is attained when polarities of segment electrode are reversed. Inverters 60, 62, NAND gate 64, AND gate 66, P-channel MOSFET 68 and N-channel MOSFET 70 constitute a circuit which is the driver for the colon segment, and numeral 42*b* denotes a segment electrode for the colon display member. Lines 56 and 58 are supplied with timing signals by divider 20. It is evident from the circuit shown that when lines 56 and 58 are provided with the signals illustrated by wave forms *a* and *b* in FIG. 7, the output signal of NAND gate 64 and the output signal of AND gate 66 produce the signal waveforms shown by *c* and *d*. Meanwhile, the source electrode of P-channel MOSFET 68 is connected to $V_H$ and the source electrode of N-channel MOSFET 70 is connected to $-V_L$. $V_H$ and $-V_L$ correspond respectively to the logic levels H and L of the circuit shown in FIG. 6. Further, the common electrode 42*a* of EC display device 42 is connected to GND, whereby GND assumes a potential substantially midway between $V_H$ and $-V_L$. Accordingly, N-channel MOSFET 70 is turned ON when the output of AND gate 66 is at H, and the colon display member attains a colored state due to an electric current which flows from GND to $-V_L$ via common electrode 42*a*, segment electrode 42*b* of colon display member, and N-channel MOSFET 70. P-channel MOSFET 68 is turned ON when the output of NAND gate 64 is at L, and the colon display member attains a bleached state due to an electric current which flows from $V_H$ to GND via P-channel MOSFET 68, segment electrode 42*b* of the colon display member, and common electrode 42*a*. After the current flows in the direction which induces the colored state, the persistence of the display member preserves the colored state until the current flows in the opposite direction to thereby induce the bleached state. Accordingly, the colon display member repetitively attains the colored and bleached states as denoted by *e* in FIG. 7. Thus, if the frequencies of signals *a* and *b* in FIG. 7 are assumed respectively to be 1 Hz and ½Hz, the colon display member will repetitively change in state at one-second intervals, a one-second bleached state following a one-second colored state.

Circuit block 72 defines a circuit for driving the segment display member. All blocks which receive display information signals produced as outputs by 7-segment decoders 36, 38, 8-segment decoder 40 and AM/PM counter 30 are identical with block 72 in construction.

Circuit block 72 is constructed as follows. The data input terminal of latch circuit 74 is applied with a display information signal produced as an output by 7-segment decoder 36, the clock input terminal is applied with a signal having a period of 1-minute produced as an output by the final stage of divider 20. The Q output terminal of latch circuit 74 is connected to one input of exclusive-OR gate 76 (hereinafter referred to as ex-OR gate 76), the other input of which is applied with a display information signal delivered from 7-segment decoder 36. The ex-OR gate 76 serves as a non-coincidence detection circuit for detecting non-coincidence between a display information signal for each dispaly element and a memory signal stored in latch circuit 74. The output of ex-OR gate 76 is supplied to one input of AND gate 78, the other input of which is provided with a current timing signal produced as an output by data-type flip-flop 80 (hereinafter referred to as D-FF 80). D-FF 80 serves as a circuit for generating a conduction timing signal to induce conduction through EC display device 42 in response to the conduction timing signal. One input of AND gate 82 is applied with the output of gate 78, and the other input of AND gate 82 is applied with a display information signal produced by 7-segment decoder 36. One input of NAND gate 84 is provided with an output from AND gate 78, and the other input of NAND gate 84 is provided via inverter 86 with a display information signal produced by 7-segment decoder 36. The source electrode of P-channel MOSFET 90 is connected to $V_H$ and the gate electrode to the output of NAND gate 84. The source electrode of N-channel MOSFET 92 is connected to $-V_L$ and the gate electrode to the output of AND gate 82. Both the drain electrodes of P-channel MOSFET 90 and N-channel MOSFET 92 are connected to each other and to segment electrode 42*c* of EC display device 42.

In general, switching an EC display device from a colored to a bleached state consumes an appreciable amount of power when employed in a wristwatch. Therefore, such change-over should be performed only when necessary. To this end latch circuit 74 and ex-OR gate 76 are provided and detect information pertaining to change-over of the states as displayed by the EC segments. Latch circuit 74 is provided as a memory circuit for storing the information displayed by the display elements, and operates according to the following truth table:

| CL | D | $Q_n$ |
|---|---|---|
| H | H | H |
| H | L | L |
| L | X | $Q_{n-1}$ |

In general, the counters for an electronic timepiece are of the negative-going edge triggered type. Accordingly, change-over of the output signal produced by 7-segment decoder 36 occurs when the signal having a 1-minute period produced as an output by the final stage of divider 20 falls. On the otherhand, when the signal having a period of 1-minute, i.e., the clock signal, is at H, latch circuit 74 performs a writting in of data. Accordingly, if the duty cycle of this signal is 50%, the output signal of latch circuit 74 will lag 30 seconds behind the display information signal received at the data terminal as an input. The ex-OR gate 76 is provided in order to detect non-coincidence of the display information signal and the memory signal stored by latch circuit 74; in other words, it is provided in order to detect a change in the display information signal. When the display information signal remains unchanged the latch output signal is brought into coincidence with the display information signal so that the output of the ex-OR gate 76 attains an L level. When the display information signal undergoes a change, the output signal of latch 74 lags further behind the display information signal and, as a result, the signals fail to coincide so that the output of ex-OR gate 76 attains an H level.

Figure 8:
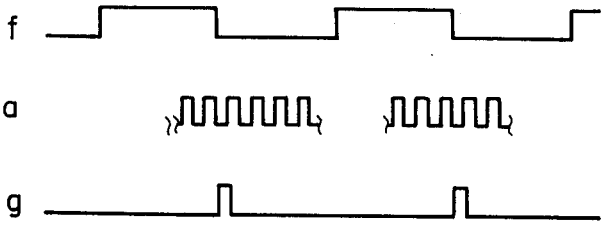

D-FF 80 is a circuit for generating conduction timing signals which regulate the conduction of the EC display device and is applied at the clock input terminal with the 1-minute period signal delivered from the final stage of divider 20, and at the reset input terminal with the other output signal from divider 20. When the clock input terminal and reset input terminal of D-FF 80 are applied with the respective signals denoted by *f* and *a* as shown in FIG. 8, a signal denoted by *g* is produced at the output terminal. This signal attains an H level for a short period of time when the signal denoted by *f* falls, that is, at a timing dictated by changes in the display information signal. This timing signal and the non-coincidence detection signal provided by ex-OR gate 76 are applied to the inputs of AND gate 78. When no non-coincidence is detected, the output of AND gate 78 remains at low level since the output of ex-OR gate 76 is at low level. When non-coincidence is detected, a conduction timing signal appears at the output of AND gate 78 since the output of ex-OR gate 76 is at high level. The conduction timing signal is a pulse produced once per minute. The signal produced upon detection of non-coincidence between the display information signal and memory signal is generated for each change in the display information signal and lasts for 30 seconds; therefore, only a single conduction timing signal for each change in the display information signal appears at the output of AND gate 78. If the display information signal is at high level when AND gate 78 produces the conduction timing signal as an output, a timing signal appears at the output of AND gate 82. When the timing signal is at high level, N-channel MOSFET 92 is turned ON and a current flows through the EC display device 42, bringing it to the colored state. In cases where the display information signal is at low level, a timing signal which has been inverted appears at the output of NAND gate 84. When the timing signal is at high level, P-channel MOSFET 90 is turned ON and a current flows through the EC display device 42, bringing it to a bleached state. In other words, the EC display element attains a colored state when the information display signal is at a high level and a bleached state when the signal is at a low level. The pulse width of the conduction timing signal can be optionally set in dependence upon the electrochromic material.

Since the level shifter and driver circuit as thus described can be formed within a C/MOS IC, the circuits are well suited for application in electronic timepieces.

Figure 9:
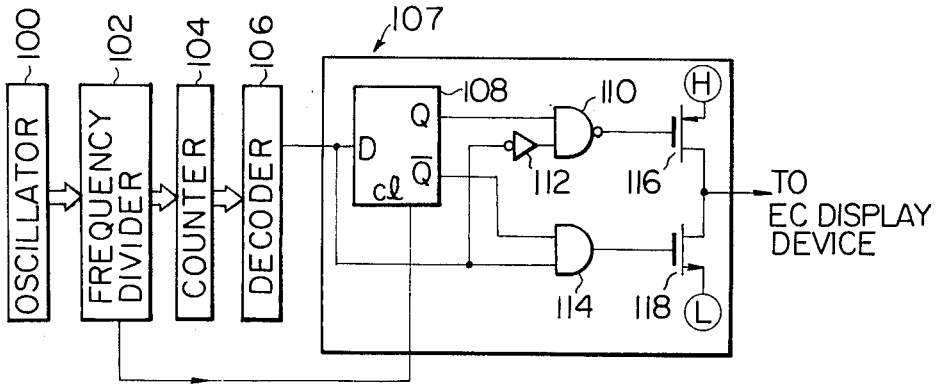
FIG. 9 is a schematic view of a modified form of the driver circuit shown in FIG. 6.

FIG. 9 shows another preferred embodiment of a driver circuit according to the present invention. In FIG. 9, while the driver circuit is shown as incorporated in an electronic timepiece, it should be noted that the driver circuit may be applied to other electronic devices such as calculators. The electronic timepiece comprises an oscillator circuit 100, an output signal from which is applied to frequency divider 102. An output signal from the final stage of frequency divider 102 is applied to counter 104, which generates time information signals. The time information signals are converted by decoder 106 into display information signals for each display element i.e., for each segment electrode. The display information signal is applied to driver circuit 107, to which a clock pulse from frequency divider 102 is also applied. Driver circuit 107 is composed of latch circuit 108 for storing the display information signals and generating an output delayed in phase from the display information signal. To this end, a latch circuit has its data input terminal coupled to receive the display information signals from decoder 106. A clock terminal of latch circuit 108 is coupled to frequency divider 102 to receive the clock pulse of a relatively higher frequency. $\overline{Q}$ output of latch circuit 108 is coupled to one input of AND gate 114, the other input of which is coupled to receive the display information signal. Thus, AND gate 114 generates an output signal synchronizing with the rising edge of the display information signal. Q output of latch circuit 108 is coupled to one input of NAND gate 110, the other input of which is coupled through inverter 112 to decoder 106 to receive inverted display information signal. Thus, NAND gate 110 generates an output signal synchronizing with the falling edge of the display information signal. In this manner, gates 110 and 114 detect non-coincidence between a display information signal from decoder 106 and a display information signal stored in latch circuit 108, thereby generating output signals as previously mentioned. An output of NAND gate 110 is coupled to the gate terminal of P-channel MOSFET 116, whose source terminal is coupled to the positive terminal of a power source. Likewise, an output of AND gate 114 is coupled to the gate terminal of N-channel MOSFET 118, whose source terminal is coupled to the negative terminal of the power source. The drain terminals of P-channel MOSFET 116 and N-channel MOSFET 118 are coupled together and connected to a segment electrode of an electrochromic display device (EC display device). As previously stated, decoder 106 generates display information signals for each segment electrode, to which the output of driver circuit 106 is coupled. It will thus be seen that driver circuits may be provided for each segment electrode. A positive level of the display information signal indicates that the corresponding display element of segment electrode of the EC display device is to be colored, while a negative level represents the corresponding display element is to be bleached. As already noted hereinabove, the EC display device will operate such that when the segment electrode is coupled to the negative terminal of the power source it provides coloration whereas when the segment electrode is coupled to the positive terminal the coloration is removed.

Figure 10:
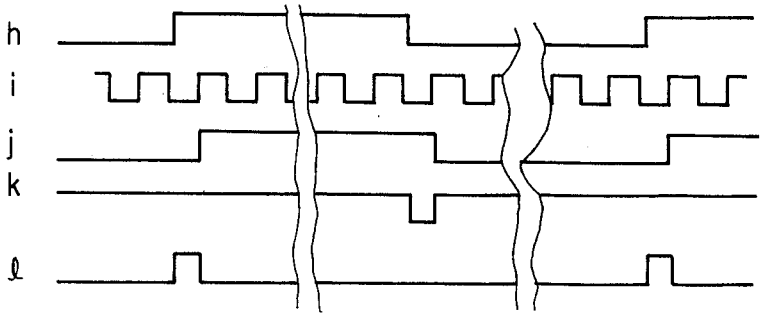
FIG. 10 is a waveform diagram illustrating the operation of the driver circuit of FIG. 9.

When a display information signal as shown by the waveform *h* in FIG. 10 is applied to the data input terminal of latch circuit 108 to the clock terminal of which is applied with a clock pulse as shown by the waveform *i* in FIG. 10, latch circuit 108 generates an output signal as shown by the wave-form *j* in FIG. 10. The output signal *j* is delayed from the display information signal *h* by a half cycle of the clock pulse *i*. It will be seen in FIG. 10 that the display information signal changes its logic level at the instant slightly delayed from the falling edge of the clock pulse *i*. The output signal *j* is applied to one input of NAND gate 110, to the other input of which is also applied an inverted display information signal. Thus, NAND gate 110 generates an output signal as shown by the waveform *k* in FIG. 10. The output signal *k* is a negative pulse which is generated each time the display information signal changes from a high to a low level. Similarly, an output signal from the $\overline{Q}$ output of latch circuit 108, i.e., an inverted output signal *j*, is applied to one input of AND gate 114 to the other input of which is also applied the display information signal *h*. Thus, AND gate 114 generates an output signal as shown by the waveform *l* in FIG. 10.

The output signal *l* is a positive pulse which is generated each time the display information signal changes from a low to a high level. The pulse width of each of the output signals *k* and *l* is equal to the time interval delayed by latch circuit 108. When the display information signal changes from the low to the high level, the output of AND gate 114 becomes high for a short period as shown by the waveform *l* in FIG. 10. In this instance, the N-channel MOSFET 118 is conductive, thereby coupling the segment electrode of the EC display device to the negative terminal of the power source to provide coloration. The segment electrode is rendered conductive for a time interval depending upon the pulse width of the output signal *l* from AND gate 114 and, thereafter, the segment electrode remains in its colored state due to its persistence effect. When, in contrast, the display information signal changes from the high to low level, the output of NAND gate 110 becomes low for a short period as shown by the waveform *k* in FIG. 10. In this instance, the P-channel MOSFET 116 is rendered conductive, coupling the segment electrode to the positive terminal of the power source to remove coloration.

It will now be appreciated from the foregoing description that in accordance with the present invention an electric current is caused to flow through the minimum number of segment electrodes of an EC display device and a power consumption is remarkably reduced. It should also be understood that a driver circuit embodying the present invention can be incorporated in an integrated circuit chip and thus is suitable for use in an electronic timepiece which requires a minimal spacing for the components.

While the present invention has been shown and described with reference to particular embodiments, it should be noted that various other changes or modifications may be made without departing from the scope of the present invention.

What is claimed is:

1. In an electronic timepiece having a power source, an oscillator circuit, a frequency divider coupled to the oscillator circuit, counter means coupled to an output of the frequency divider to generate clock pulse information signals, decoder means for converting the time information signals into display information signals, and an electrochromic display device having a plurality of display elements, the improvement comprising:

a latch circuit, having data and clock input terminals and Q and $\overline{Q}$ output terminals, said data input terminal is coupled to an output of said decoder means and said clock input terminal coupled to the frequency divider to receive a clock pulse therefrom, said latch circuit for storing display information signals delivered from the decoder means and generating output signals delayed for a time interval from the display information signals;

a NAND gate, having two inputs, one input coupled through an inverter to the output of said decoder means, for generating a first output pulse, in response to a falling edge of each display information signal having a pulse width;

an AND gate, having two inputs, one input coupled to said $\overline{Q}$ output of the latch circuit and the other input coupled to the output of said decoder means, for generating a second output pulse, in response to a rising edge of each display information signal having a pulse width;

a P-channel MOSFET responsive to the first output pulse to cause the flow of electric current through said display element in a bleaching direction; and an N-channel MOSFET responsive to the second output pulse to cause the flow of electric current through said display element in a coloring direction.

2. The improvement according to claim 1, in which said pulse width of each of the first and second output pulses is equal to the time interval delayed by the latch circuit.

* * * * *